US006533001B1

(12) United States Patent
Adriansens et al.

(10) Patent No.: US 6,533,001 B1
(45) Date of Patent: Mar. 18, 2003

(54) FILLING MACHINE WITH FILLING HEADS THAT ARE RESPECTIVELY PROVIDED WITH A DOWNWARD SKEWED VALVE

(75) Inventors: Eric Adriansens, Le Havre Cedex (FR); Eric Meunier, Le Havre Cedex (FR); Rodolphe Saint-Martin, Le Havre Cedex (FR)

(73) Assignee: Sidel, Lehavre Cedex (FR)

( * ) Notice: Subject to any disclaimer, the term of this patent is extended or adjusted under 35 U.S.C. 154(b) by 0 days.

(21) Appl. No.: 09/869,373

(22) PCT Filed: Dec. 7, 1999

(86) PCT No.: PCT/FR99/03049

§ 371 (c)(1),
(2), (4) Date: Jun. 28, 2001

(87) PCT Pub. No.: WO00/40505

PCT Pub. Date: Jul. 13, 2000

(30) Foreign Application Priority Data

Jan. 6, 1999 (FR) ..... 99 00116

(51) Int. Cl.[7] ..... B65B 3/00; B67C 3/00
(52) U.S. Cl. ..... 141/145; 141/89
(58) Field of Search ..... 141/144–152, 141/89–91

(56) References Cited

U.S. PATENT DOCUMENTS

| | | | | | |
|---|---|---|---|---|---|
| 2,614,742 | A | | 10/1952 | Price | |
| 3,604,480 | A | * | 9/1971 | Reichert | 141/39 |
| 4,456,040 | A | * | 6/1984 | Bacroix et al. | 141/150 |
| 4,817,683 | A | * | 4/1989 | Laub, III et al. | 141/144 |
| 4,964,444 | A | * | 10/1990 | Hanerus et al. | 141/90 |
| 5,313,990 | A | * | 5/1994 | Clusserath | 141/147 |
| 5,562,129 | A | * | 10/1996 | Graffin | 141/90 |
| 5,865,225 | A | * | 2/1999 | Weiss | 141/145 |

FOREIGN PATENT DOCUMENTS

| | | |
|---|---|---|
| DE | 869 015 | 3/1953 |
| EP | 0 486 440 | 5/1992 |

* cited by examiner

*Primary Examiner*—J. Casimer Jacyna
(74) *Attorney, Agent, or Firm*—Sughrue Mion, PLLC

(57) ABSTRACT

A filling machine including at least one filling tube (22), whereby a product flows through said filling tube and said filling tube is placed opposite the opening of a receptacle that is to be filled. The feed for the filling tube is controlled by a valve (30) which is arranged in a downward skewed position in relation to the tube and the valve is joined to the tube by a feed pipe (28).

11 Claims, 3 Drawing Sheets

FILLING MACHINE WITH FILLING HEADS THAT ARE RESPECTIVELY PROVIDED WITH A DOWNWARD SKEWED VALVE

BACKGROUND OF THE INVENTION

The invention specifically concerns machines that make it possible to fill hollow containers such as bottles or pots, with a product, for example, a food product. Such machines generally comprise a rotating carousel, which holds a series of filling spouts. The containers are mounted on the carousel at a given point on the circle that it describes, being arranged below a filling spout. Once the container is placed under the spout, the latter is filled with product in such a way that the product is poured into the inside of the container. When a desired degree of filling is achieved, the feed from the spout is interrupted by a valve installed in the feed circuit of the spout and the container is then removed from the carousel, it being understood that this is before the carousel has made a complete revolution.

The arrangement of the multiple spouts on a carousel makes it possible for the machine to insure the filing of a number of containers simultaneously. It makes it possible to insure filling a significant number of containers in a given period of time, in spite the fact that the filling is an operation that takes a relatively long time. In fact, it is especially necessary to prevent the product from foaming too much, which would lead to an only partial filling of the container or to a loss of product by overflow. A filling machine can thus contain more than one hundred spouts, each spout having an associated valve.

In conventional filling machines, the distribution valve, which controls the product feed across the feed pipe, is connected to the filling spout. The valve and the spout are then either integrated directly in the same housing or separated from each other by a short distance.

However, the fact of having the valve close to the spout poses space requirement problems, particularly in the case of carousel machines having a significant number of spouts. Thus, the space requirement constraints in the area of the carousel zone where the spouts are fitted generally lead to machine designs in which the valves are not very accessible. This lack of accessibility makes maintenance of the valves difficult and, in the case of breakdown, increases the time for repair.

In addition, these great space requirement constraints may make it impossible to use certain types of valves.

To remedy these inconveniences, the invention proposes a filling machine of the type containing at least one filling spout through which a product runs, the spout being intended to be placed across from the opening of a container to be filled, characterized in that the supply to the filling spout is controlled by a valve which is skewed with respect to the spout, the valve being connected to the spout by a feed pipe.

SUMMARY OF THE INVENTION

According to other characteristics of the invention:

- the valve is skewed vertically toward the bottom with respect to the filling spout;
- the valve is skewed vertically toward the bottom with respect to the container to be filled, the latter being itself arranged below the filling spout;
- the valve is fitted together so that it is essentially vertical to the filling spout;

- the valve contains a vertical sealing pin that is completely held in a vertical circulation chamber across which the product runs, the lower end of the circulation chamber is delimited by a seat against which the pin moves into place toward the bottom to interrupt the circulation of the product, and the pin is lifted upward in the circulation chamber by an electromagnetic field in order to be lifted from the seat in order to allow the passage of the product across the valve;
- the machine has several filling stations each containing a filling spout and an associated valve and the filling stations are held on a rotary carousel and are offset at an angle to each other in a regular manner around the axis or rotation of the carousel;
- the valves are fitted in an external radial part of the carousel;
- the filling spout is surrounded in a fixed housing that is attached to the spout, the housing containing a passage hole across which the spout is fitted, and the housing contains a mobile closing flap which, in the closed position, blocks of the opening and closes the housing in a sealed manner and the machine has the means to cause a cleaning agent to circulate inside the housing;
- the closing flap is controlled by actuating means between its closed position and an open position, in which the hole of the housing is open;
- the housing extends in a direction that is essentially perpendicular to the flowing direction of the product; and
- the fixed housing of each filling station is attached to the carousel.

BRIEF DESCRIPTION OF THE DRAWINGS

Other characteristics and advantages of the invention will be found upon reading the detailed description that follows, as well as in the drawings attached, in which.

DETAILED DESCRIPTION OF THE ILLUSTRATIVE EMBODIMENTS

Figure 1:
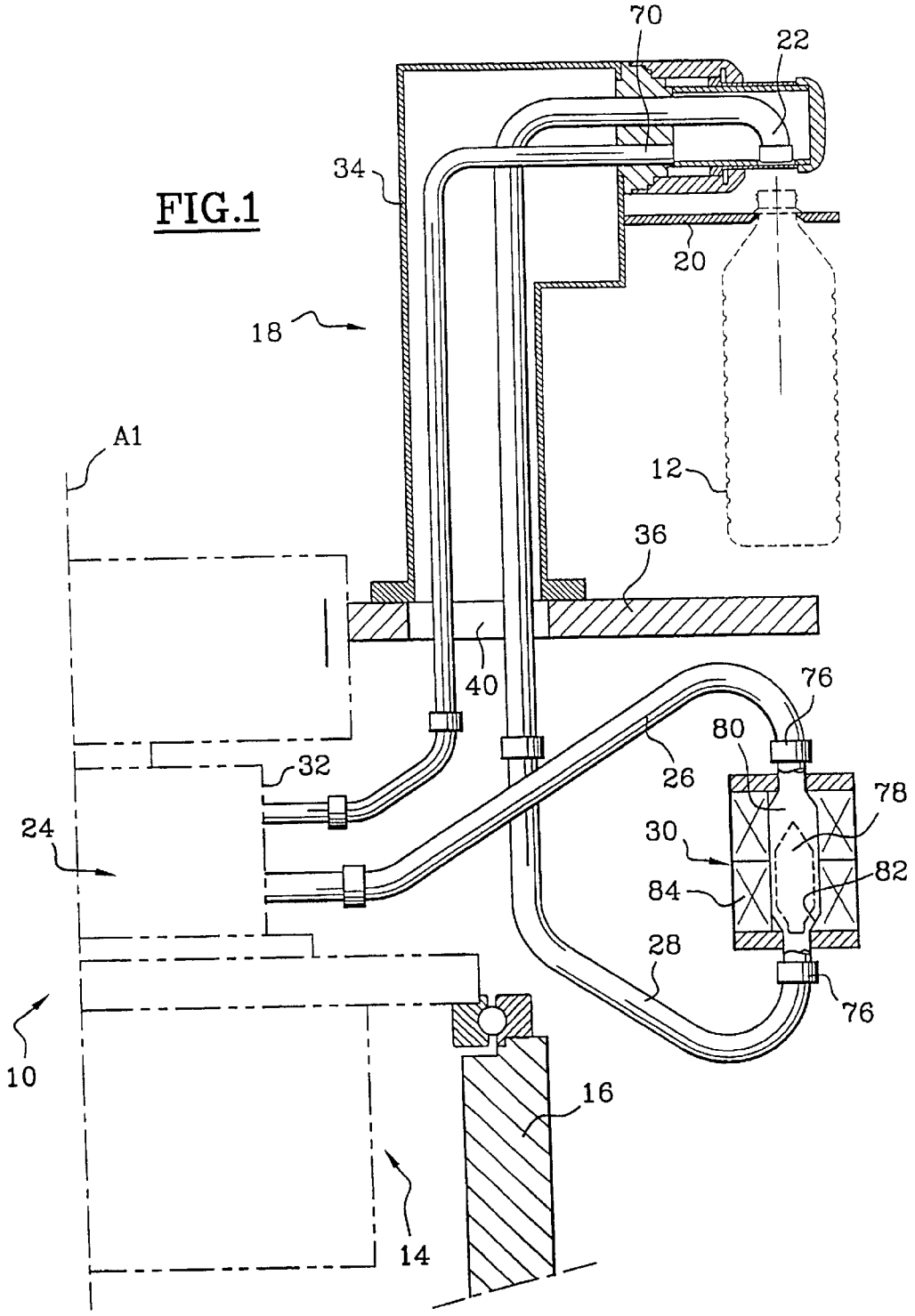
FIG. 1 is a schematic axial cross section view showing one part of a carousel of a filling machine designed according to the invention.

FIG. 1 schematically and partially illustrates a filling machine 10 intended to insure the filling of containers, such as bottles 12, with a liquid, e.g. a flat liquid such as water. Naturally, the invention may be used for filling any type of container with any type of product.

The machine 10 is a rotating machine, which comprises a carousel 14 mounted so that it turns with respect to a fixed stand 16, around axis A1, which, for the sake of convenience, will be considered to be vertical.

The carousel 14 comprises a series of filling stations 18, which have an offset to each other at an angle in a regular manner around axis A1 but of which a single one is illustrated in the figures. Each filling station 18 is the same for carrying out the filling of a bottle 12. For this purpose, it has, in particular, a device 20 for supporting bottle 12, a filling spout 22 by which the product intended to fill the bottle pours out, and a supply circuit which is mounted between the spout 22 and a rotating distributor 24 of machine 10.

The supply circuit comprises a feed pipe having two lengths of pipe upstream 26 and downstream 28 between which a valve 30 is fitted which makes it possible to control the flow of product in the circuit and thus the distribution of the product into the container.

The rotating distributor 24 is fitted in the bottom part of carousel 14, radially to the center of same. It comprises a fixed part on which feed pipes (not shown) are arranged which are fastened to stand 16 and which in particular allow the carousel to be supplied with product and in addition, as will be seen later, a cleaning agent and compressed air.

In addition, distributor 24 has a rotating part 32 on which the pipes are connected, including the feed pipes 26, 28. The two parts of the rotating distributor 24 have communication means, which make it possible to selectively join the feed pipes fastened to the corresponding pipes of the carousel.

Each filling station 18 comprises a vertical hollow column 34 which is fastened by its lower end to a horizontal plate 36 and which has, at its upper end, the filling spout 22 which extends toward the outside essentially along a radius with respect to axis A1.

The valve 30 is fitted below plate 36, essentially vertical to the associated filling spout 22 in such a way that the upstream piece of pipe 28 of the feed duct extends across a hole 40 in plate 36 to the interior of column 34.

Naturally, the filling operation must be carried out while avoiding any contamination of the product. This is critical when the product is a food product and all the more so in the case of milk products, for example.

Thus, it is necessary to carry out a cleaning of the filling machine at regular intervals. The cleaning can consist of removing all traces of the product, of removing dust and other foreign bodies with the intention of eliminating biological or bacteriological contaminants. In the sense of the present patent, the cleaning may thus include the concepts of washing, disinfecting, decontaminating and sterilizing.

The cleaning is usually carried out with a liquid or gaseous cleaning agent, which is allowed to circulate in the circuit contacted by the product on the inside of the machine. In order to limit the consumption of cleaning agent, and above all to facilitate its recovery with the intention of possible recycling, preferably the agent is allowed to circulate inside a closed circuit.

For this purpose, column 34 of the machine described has, at its upper end, a housing 38 in which the enclosed filling spout 22 is found in order to make it easy to clean spout 22 and in order to create a closed circuit.

Figure 2:
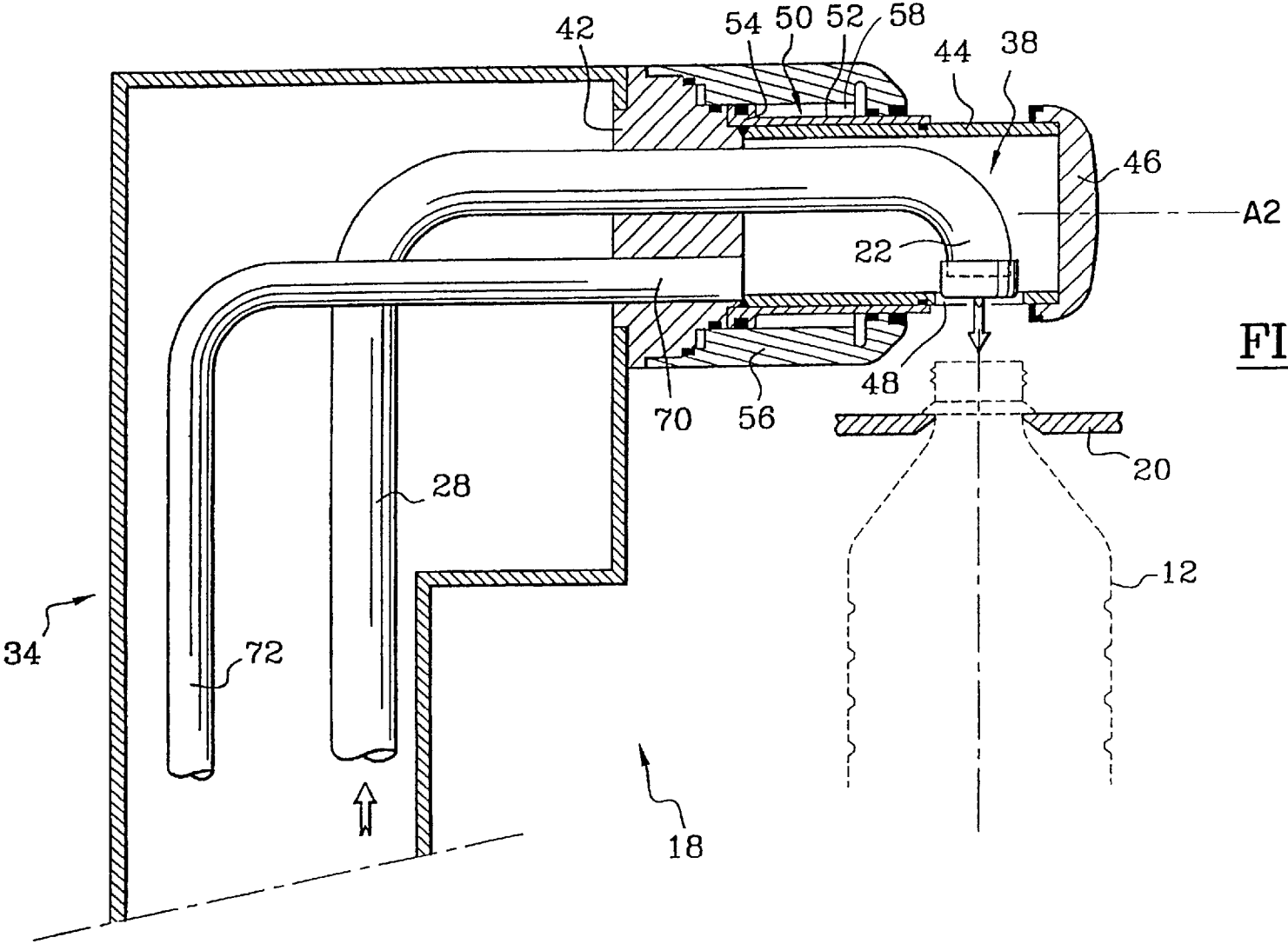
FIG. 2 is a detailed view of FIG. 1 showing, most particularly, the cleaning housing of a filling spout as well as a closing flap and its actuating means, the flap being illustrated in open position.
Figure 3:
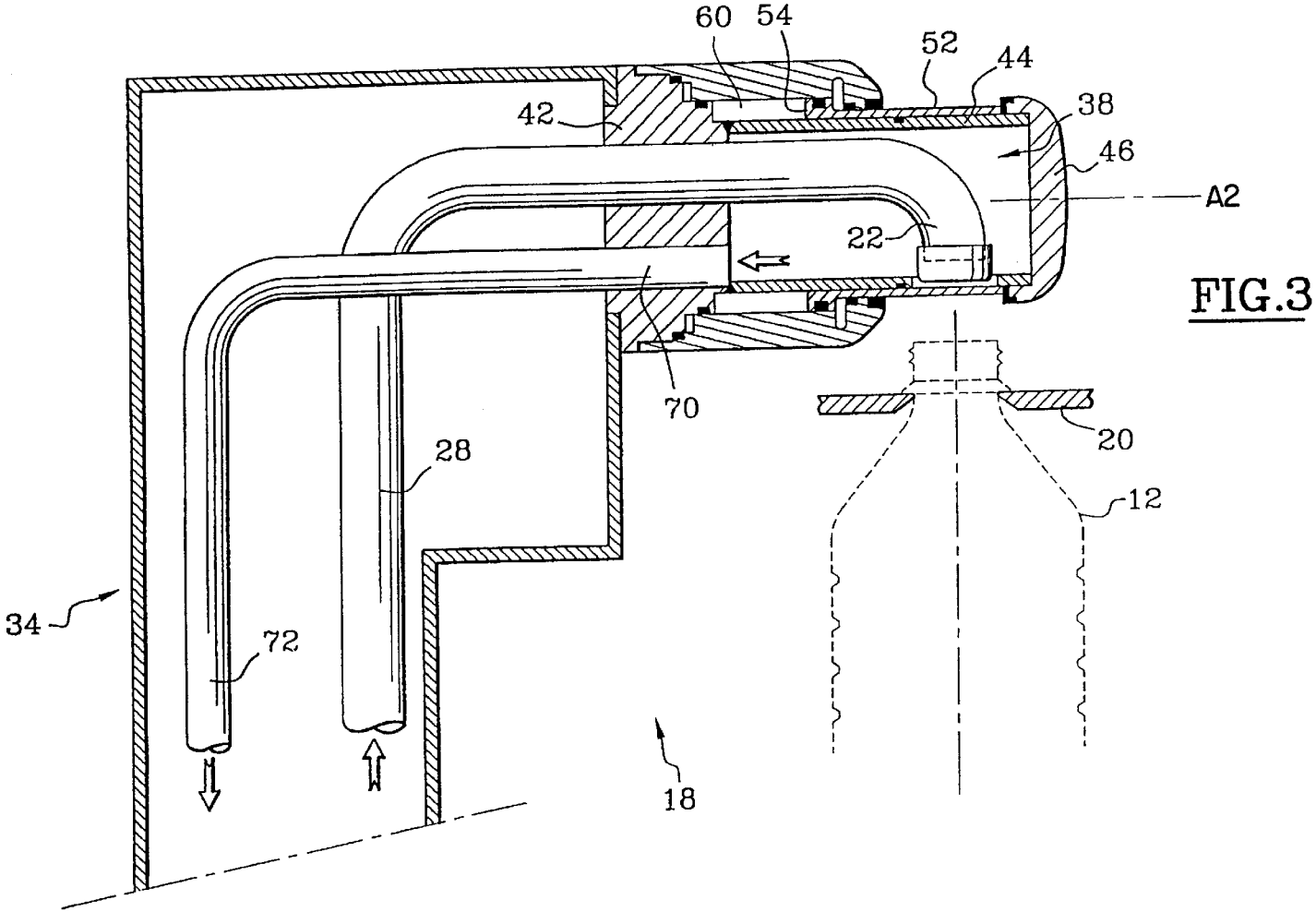
FIG. 3 is a view identical to the one in FIG. 2 in which the flap is illustrated in the closed position.

As can be seen, especially in FIGS. 2 and 3, the end part of the upstream piece of pipe 28 of the feed pipe extends in a plane that is radial with respect to axis A1 in such a way that the housing is fixed extending radially toward the outside with respect to column 34. The housing 38 comprises a base 42 which is fastened on column 34 and which is extended radially toward the outside by a tubular wall with revolution 44 around radial axis A2. The wall 44 is closed at its external radial end with an end wall 46 which is made up, for example of a plug that is screwed in, in a sealed manner on wall 44.

The end part of the feed pipe 28 crosses base 42 in a sealed manner to open out into the closed space delimited by tubular wall 44. The filling spout 22 is curved toward the bottom to be located across from an orifice 48 placed in wall 44, this orifice 48 itself being across from the filler opening of bottle 12 when the latter is placed on its support 20.

Advantageously, housing 38 comprises a mobile flap 50 which makes it possible to close orifice 48 so that the housing delimits a partially closed and sealed space in which spout 22 is enclosed.

The flap 50 is made up of a tubular sleeve 52 which is mounted so that it slides on tubular wall 44 and on the outside of same. The flap 50 may thus move between an open position illustrated in FIG. 2, in which it is pulled back in such a way as to release orifice 48 and a closed position illustrated in FIG. 3, in which it is moved in such a way as to cover orifice 48.

The rear end of sleeve 52 has the form of a collar 54 which slides in a sealed way in the inside of an annular chamber delimited around the tubular wall 44 by a tubular shell 56 with axis A2 which surrounds the rear end of the wall 44. The collar 54 thus plays the role of a piston, which delimits in its chamber two parts front 58 and back 60. The respective volume of these two parts 58, 60 is thus variable as a function of the collar position and thus the position of flap 50 along axis A2.

Also by imposing a fluid pressure in one or the other of parts 58, 60 of the chamber, a displacement is imposed on flap 50 toward one or the other of these positions, open or closed. In other words, the collar 54 and the two parts 58, 60 of the chamber form an actuator with double-action fluid pressure.

When the machine has several spouts, it is possible to provide that each filling station 18 would be equipped with its own electrical control valve for flap 50. Actuation of flaps 50 is carried out individually and thus may possibly have shifted over time from one spout to another. However, when the machine has a significant number of filling spouts, the machine may have a single electrical control valve for all the spouts.

In both these cases, due to the invention, the actuation of the flaps can be carried out simultaneously on all the spouts in a very short time. Advantageously, the actuation of the flaps may be carried out when the carousel is in rotation.

When housing 38 is closed by flap 50, it is possible to create a cleaning agent circulation on the inside making it possible to clean not just the inside of spout 22, but also the exterior of same. To do this, a cleaning liquid, which fills housing 38 is allowed to circulate across the intake duct, valve 30 and spout 22. The liquid is then evacuated from the housing over an auxiliary port 70 which is arranged in base 42 and which opens out into the interior of the housing. The auxiliary port 70 is, for example, connected by an auxiliary pipe 72 and by the distributor 24 to a recovery and recycling device for the cleaning liquid, which makes it possible to limit the consumption.

Preferably, the auxiliary port 70 is fitted in such a way as to open out at a low point of housing 38, to make possible the most complete evacuation of the cleaning liquid by the auxiliary pipe 72.

In an advantageous manner, to further improve the cleanliness during the filling with the use of such a machine, it can be provided that at the moment of filling, a sterile gas such as sterile air, nitrogen or carbon dioxide is injected into the inside of housing 38. The sterile gas then fills the internal volume of housing 38 and escapes across orifice 48 by surrounding the jet of product that is delivered by the filling spout in the direction of bottle 12. Thus, the product is isolated by a sterile gas envelope between spout 22 and bottle 12 and is not exposed to any possible sources of environmental pollution. Advantageously, the sterile gas may be introduced into housing 38 across the same auxiliary port 70, which is used to evacuate the cleaning agent in the course of the machine cleaning phases.

According to the invention, the valve 30, which controls the circulation of the product in the feed pipe 26, 28 is skewed, in this case skewed vertically toward the bottom, with respect to the filling spout.

In fact, it can be seen that this valve 30 is fitted below the plate 36 while the containers to be filled are intended to come over it when they are in place on their support, the containers then being located below the filling spout.

In the configuration illustrated, the valve 30 is thus located essentially vertical to the spout to which it is connected.

In this way, in the machine according to the invention, the length of the upstream piece of pipe 28, which connects the valve 30 to spout 22, is at least equal to 50 centimeters and it can reach a length greater than one meter. This provision presents several advantages.

A first advantage is in the possibility of fitting the valve 30 in a location where it is easily accessible to be able to insure maintenance. In fact, in the machine described, it is located in the radial external part of the carousel and not in the center of same, behind spout 22, as in the case in previously known machines.

In addition, it can be seen that the valve 30 is connected by two removable connections 76, respectively to upstream 26 and downstream 28 end pieces of the feed pipe. Thus, if the valve fails, it is very easy to access it and remove it to replace it in a minimum amount of time with a new valve while the machine is in operation, which makes it possible to considerably reduce the machine down time and thus the time that the production line in which the machine is included is down.

A second advantage consists in the case of machines having a significant number of spouts 22. In fact, the angular space available for each filling station 18 is limited. By arranging the valves 30, each connected with these spouts 22 on a large diameter circle, with essentially the same diameter on which the spouts are fitted, each valve 30 has a space that is adequate to allow easy installation and such that space requirements will not be a determining factor is choosing the technology used for the valve.

Thus, in the machine illustrated, a choice has been made to use electromagnetic valves of the type described in the documents DE-A-1.600.719 or FR-A-2.206.726.

As is illustrated very schematically in FIG. 1, this type of valve comprises a core 78 which is able to move in a circulation chamber 80, across which the product can circulate. The circulation chamber is vertical throughout and it is delimited at its lower end by a seat 82 against which the core 78 comes into contact to interrupt the circulation of the product across valve 30.

To open the valve, electromagnetic means 84, such as coils or magnets, make it possible to create magnetic fields around the chamber which cause a raising of core 78 in such a way that it lifts off seat 82, thus freeing the passage for the product.

One advantage of this type of valve is that it is the normally closed type, that is, just because of the effect of its weight, the core 78 drops down against the seat 82 and obstructs the passage of the product. Thus if there is a failure of the electromagnetic means, valve 30 closes automatically. This is achieved without it being necessary to arrange elastic retraction means in circulation chamber 80, which thus makes it particularly easy to clean.

Still, this advantage is naturally not obtained except by keeping the valve in the vertical position shown. Thus, since the orientation of the valve is imposed, it is necessary to arrange a certain space for installing it, which allows the design according to the invention.

In addition, since the valve is mounted separate from the spouts, this makes it possible to free a great deal of space around the latter, it is thus possible to design the fairings in relatively simple shapes which do not gather dirt that is difficult to clean.

Finally, since the volume of filling spout 22 does not include the volume of the valve, the housing 38 in which spout 22 is located remains closed, possibly also with reduced volume.

What is claimed is:

1. A filling machine comprising:

more than one filling station, each comprising a filling spout through which a product runs, the spout being located across from the opening of a container to be filled, and the filling stations being held on a rotating carousel and are offset to each other at an angle around an axis of rotation of the carousel; and a valve associated with each station which controls a supply of the filling spout and which is connected to the spout by a feed pipe, the valve being positioned below the filling spout, wherein, for each station, the valve has two distal end portions and is positioned such that a flow of product through the valve is vertically oriented from one of said two end portions to another of said two end portions, and the valve is fitted in an external radial part of the carousel.

2. The filling machine according to claim 1, wherein the valve is fitted essentially vertical to the filling spout.

3. The filling machine according to claim 1, wherein the valve comprises a vertical closing pin which is entirely held in a vertical circulation chamber over which the product runs, and the lower end of the circulation chamber is delimited by a seat against which the pin comes to rest toward a bottom of the circulation chamber to interrupt the product circulation and wherein the pin is lifted upward in the circulation chamber by an electromagnetic field in order to be lifted off the seat to allow the passage of the product across valve.

4. The filling machine according to claim 1, wherein the filling spout is enclosed in a fixed housing that is attached to a support of the filling spout, the housing comprising a passage orifice across from which the spout is fitted and a mobile closing flap which in a closed position closes the orifice and closes the housing in a sealed manner, the machine further comprises means to make a cleaning agent circulate on the inside of the housing.

5. The filling machine according to claim 4, wherein the closing flap is controlled by actuating means between its closed position and its open position, in which the orifice of the housing is released.

6. The filling machine according to claim 4, wherein the housing extends in a direction that is essentially perpendicular to a flow direction of the product.

7. The filling machine according to claim 1, wherein the fixed housing of each filling station is attached to the carousel.

8. A filling machine, of the type comprising several filling stations, each comprising a filling spout through which a product runs, the spout being located across from an opening of a container to be filled, each station having an associated valve which controls a supply of the filling spout and which is connected to the spout by a feed pipe of the type in which the filling stations are held on a rotating carousel and are offset from each other at an angle around the axis of rotation of the carousel, wherein, for each station, the valve is skewed vertically toward the bottom with respect to the container to be filled and is fitted in an external radial part of the carousel, and wherein the valve comprises a vertical closing pin which is entirely held in a vertical circulation chamber over which the product runs, such that the lower end of the circulation chamber is delimited by a seat against which the pin comes to rest toward the bottom to interrupt a product circulation and such that the pin is lifted upward in the circulation chamber by an electromagnetic field in order to be lifted off the seat to allow a passage of the product across the valve.

9. A filling machine, of the type comprising several filling stations, each comprising a filling spout through which a product runs, the spout being located across from an opening of a container to be filled, each station having an associated valve which controls a supply of the filling spout and which is connected to the spout by a feed pipe of the type in which the filling stations are held on a rotating carousel and are offset from each other at an angle around the axis of rotation of the carousel, wherein, for each station, the valve is skewed vertically toward the bottom with respect to the container to be filled and is fitted in an external radial part of the carousel, and wherein the filling spout is enclosed in a fixed housing that is attached to a support of the filling spout, the housing comprising a passage orifice across from which the spout is fitted and a mobile closing flap which in a closed position closes the orifice and closes the housing in a sealed manner, the machine further comprises means to make a cleaning agent circulate on the inside of the housing.

10. The filling machine according to claim 9, wherein the closing flap is controlled by actuating means between its closed position and its open position, in which the orifice of the housing is released.

11. The filling machine according to claim 9, wherein the housing extends in a direction that is essentially perpendicular to a flow direction of the product.

* * * * *